US007665863B2

(12) United States Patent
Tseng

(10) Patent No.: US 7,665,863 B2
(45) Date of Patent: Feb. 23, 2010

(54) LIGHT-EMITTING DIODE AND A FAIRY LIGHT WITH THE LIGHT-EMITTING DIODE

(76) Inventor: Wei-Jen Tseng, 5F, No. 10, Lane 23, Tungshan St., Hsinchu City (TW)

( * ) Notice: Subject to any disclaimer, the term of this patent is extended or adjusted under 35 U.S.C. 154(b) by 0 days.

(21) Appl. No.: 12/213,721

(22) Filed: Jun. 24, 2008

(65) Prior Publication Data

US 2009/0318027 A1 Dec. 24, 2009

(51) Int. Cl.
*F21V 21/005* (2006.01)

(52) U.S. Cl. ..... 362/249.02; 439/460

(58) Field of Classification Search ..... 439/611, 439/617, 618, 874, 460, 942; 362/122, 654, 362/800, 806, 249.1, 249.02, 249.06; 313/318.01
See application file for complete search history.

(56) References Cited

U.S. PATENT DOCUMENTS 2,010,084 A * 8/1935 Howe ..... 439/617
2,900,492 A * 8/1959 Bossi ..... 362/122
4,427,255 A * 1/1984 Cox ..... 439/548
4,687,965 A * 8/1987 Sanders et al. ..... 313/318.05
5,644,189 A * 7/1997 Busby ..... 313/318.01
6,406,173 B1 * 6/2002 Serizawa et al. ..... 362/545
6,514,105 B2 * 2/2003 Lin ..... 439/699.2
7,108,397 B2 * 9/2006 Wu ..... 362/249.05
7,186,363 B2 * 3/2007 Yabusaki et al. ..... 264/219
2008/0285278 A1 * 11/2008 Bole ..... 362/249

* cited by examiner

*Primary Examiner*—Neil Abrams
(74) *Attorney, Agent, or Firm*—Bacon & Thomas, PLLC

(57) ABSTRACT

A light-emitting diode (LED) has a body and two terminals protruding from a bottom of the body. Each terminal has at least one distal and proximal positioning protrusions. A fairy light of the LED has a casing, two wires being mounted in the casing and a partition being mounted between the wires. The distal and proximal positioning protrusions of the terminals of the LED hold insulating shells and electric cords of the wires. Thus, the LED is easily, securely and stably to be electrically connected to the wires so an assembling procedure can be done with automatic machines. Furthermore, the LED is held in position with the partition being mounted between the wires. Therefore, not only assembling processes but also assembling components of the LED and the fairy light with the LED are saved. Consequently, manufacturing costs are saved.

16 Claims, 6 Drawing Sheets

LIGHT-EMITTING DIODE AND A FAIRY LIGHT WITH THE LIGHT-EMITTING DIODE

BACKGROUND OF THE INVENTION

1. Field of the Invention

The present invention relates to a light-emitting diode (LED) and a fairy light with the LED, especially to an LED that is easily and securely to be mounted in the fairy light.

2. Description of the Prior Arts

With reference to FIG. 6, a conventional fairy light (60) comprises a casing (61), a socket (62), a light-emitting diode (LED) (63), two wires (64) and a partition (65). The casing (61) is tubular and has a light mount and a wire mount. The socket (62) is mounted in the light mount of the casing (61) and has a top and two through holes. The through holes are formed through the socket (62). The LED (63) is mounted in the top of the socket (62) and has two terminals (631). The terminals (631) are mounted respectively through the through holes of the socket (62). The wires (64) are mounted into the wire mount of the casing (61) and electrically and respectively connect with the terminals (631) of the LED (63). The partition (65) is mounted in the wire mount of the casing (61), between the wires (64) to prevent the wires (64) from departing from the casing (61) or short-circuiting between each other.

However, the wires (64) and the partition (65) should be mounted in the wire mount of the casing (61). The LED (63) should be mounted in the socket (62) first and then the socket (62) with the LED (63) is mounted in the light mount of the casing (61) to allow the terminals (631) of the LED (63) to be electrically connected to the wires (64). There are many assembling components and procedures. Moreover, the assembling procedures cannot be done with automatic machines. Most of the time, the assembling procedures should be done with hands. Therefore, the manufacturing costs and the manpower are a lot. Furthermore, the terminals (631) of the LED (63) and the wires (34) is only connected by the terminals (631) abutting the wires (64) so the connection between the terminals (631) and the wires (34) is disconnected easily.

To overcome the shortcomings, the present invention provides a light-emitting diode and a fairy light with the light-emitting diode to mitigate or obviate the aforementioned problems.

SUMMARY OF THE INVENTION

The main objective of the present invention is to provide a light-emitting diode (LED) and a fairy light of the LED. The LED has a body and two terminals protruding from a bottom of the body. Each terminal has at least one distal wire gripping protrusion and at least one proximal wire griping protrusion. The fairy light has a casing, two wires being mounted in the casing and a partition being mounted between the wires.

The distal and proximal wire gripping protrusions of the terminals of the LED hold insulating shells and electric cords of the wires. Thus, the LED is easily, securely and stably to be electrically connected to the wires so an assembling procedure can be done with automatic machines. Furthermore, the LED is held in position with the partition being mounted between the wires. Therefore, not only assembling processes but also assembling components of the LED and the fairy light with the LED are saved. Consequently, manufacturing costs are saved.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
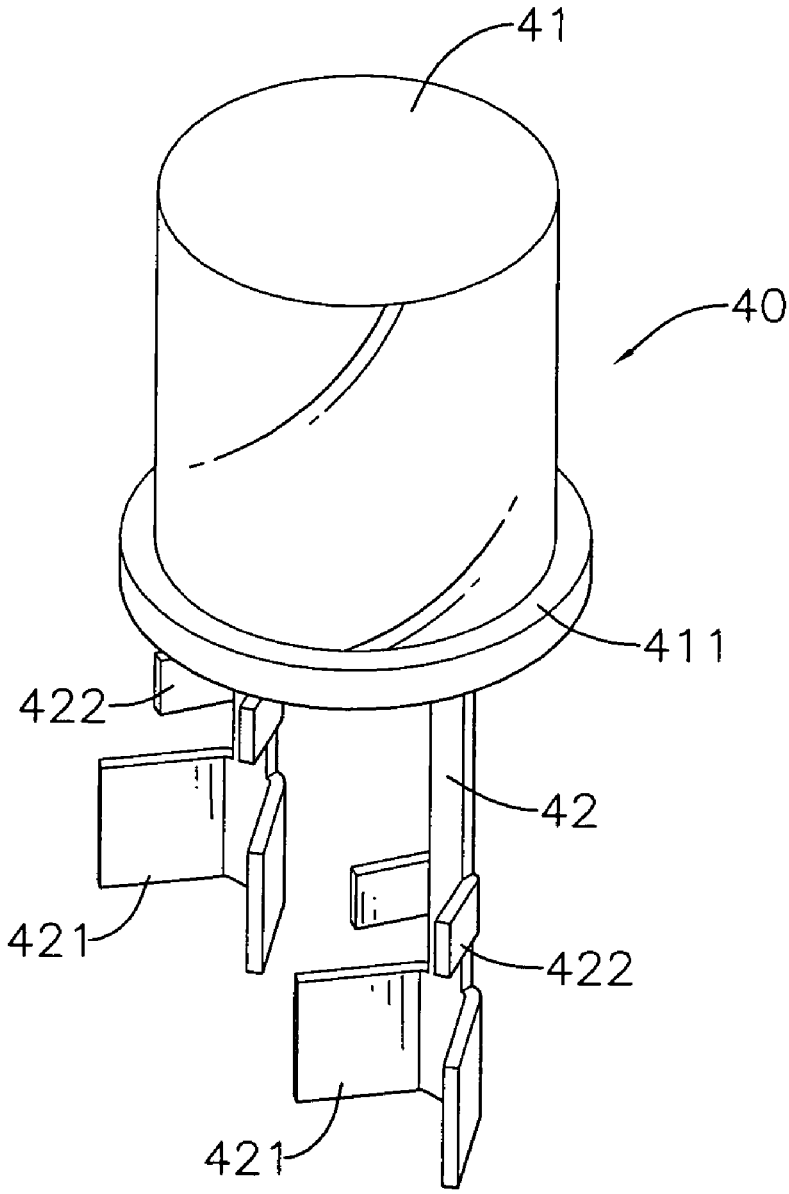
FIG. 1 is a perspective view of a light-emitting diode (LED) in accordance with the present invention.

With reference to FIG. 1, a light-emitting diode (LED) (40) in accordance with the present invention comprises a body (41) and two terminals (42).

The body (41) has an outer surface and a bottom and may have an annular flange (411). The annular flange (411) is formed around the outer surface of the body (41) near the bottom of the body (41).

The terminals (42) protrude from the bottom of the body (41). Each terminal (42) has at least one distal wire gripping protrusion (421) and at least one proximal wire gripping protrusion (422). Each one of the at least one distal and proximal wire gripping protrusion (421, 422) is formed transversely on and protrudes from the corresponding terminal (42) and may be arc for the convenience of use.

Figure 2:
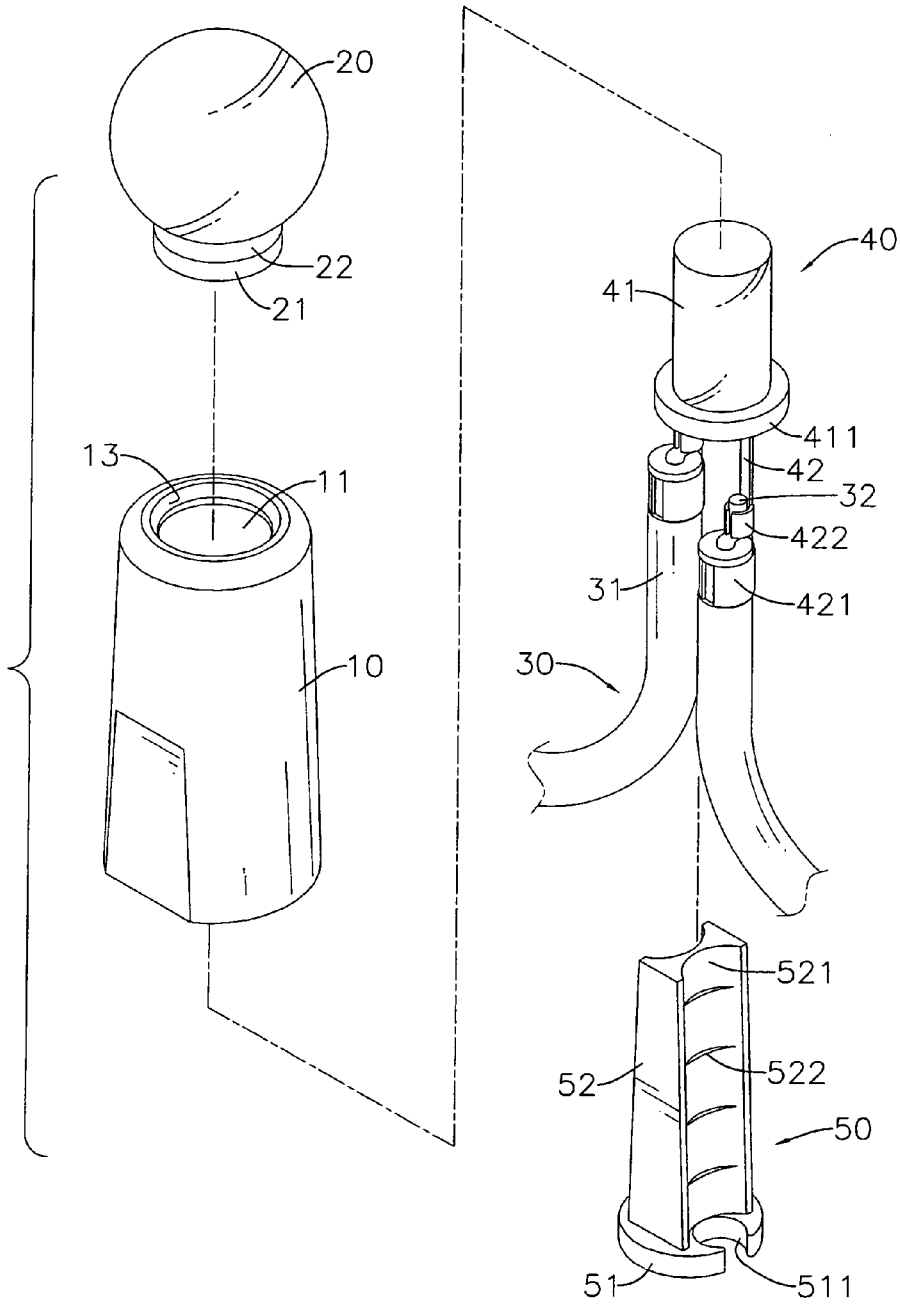
FIG. 2 is an exploded perspective view of a fairy light in accordance with the present invention.
Figure 3:
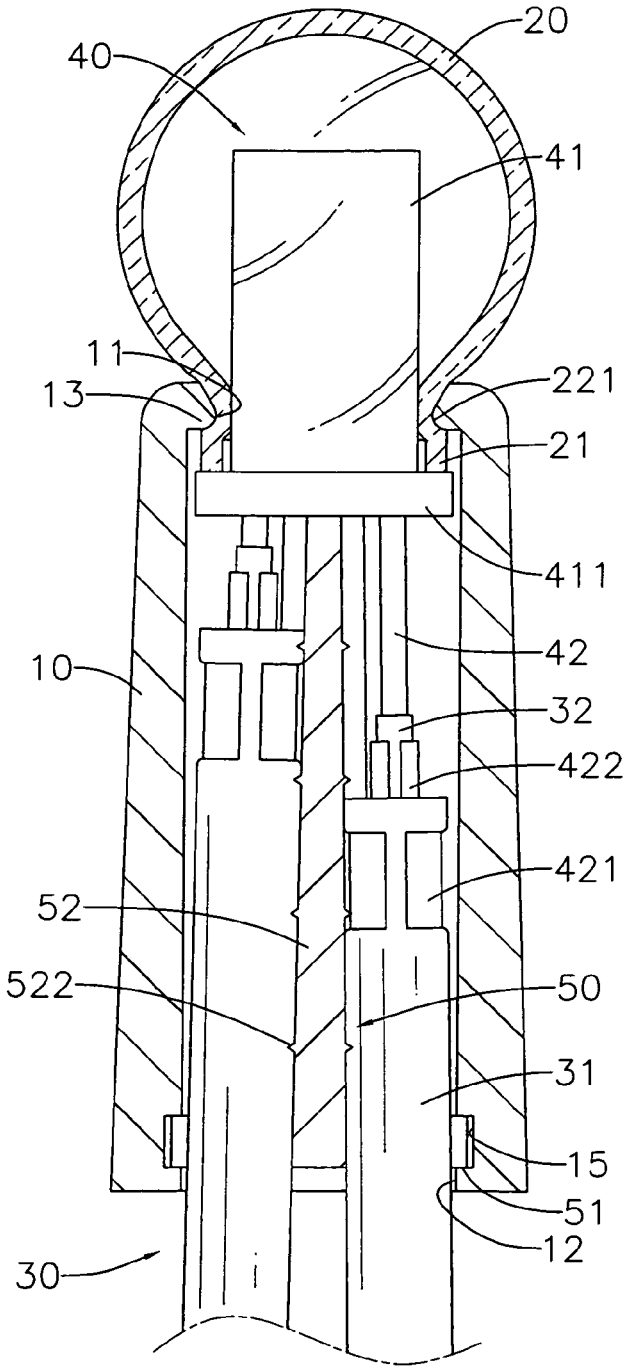
FIG. 3 is a side view in partial section of the fairy light in FIG. 2.
Figure 5:
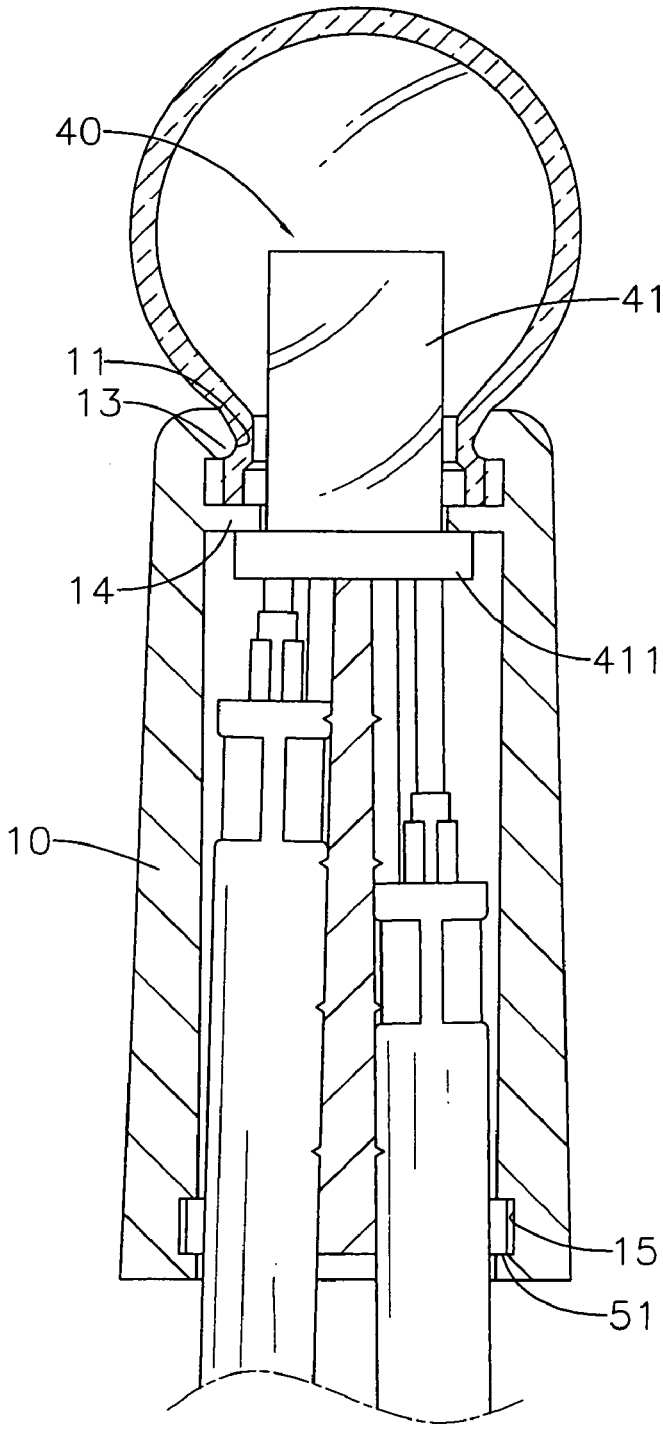
FIG. 5 is a side view in partial section of another embodiment of a fairy light in accordance with the present invention.
Figure 6:
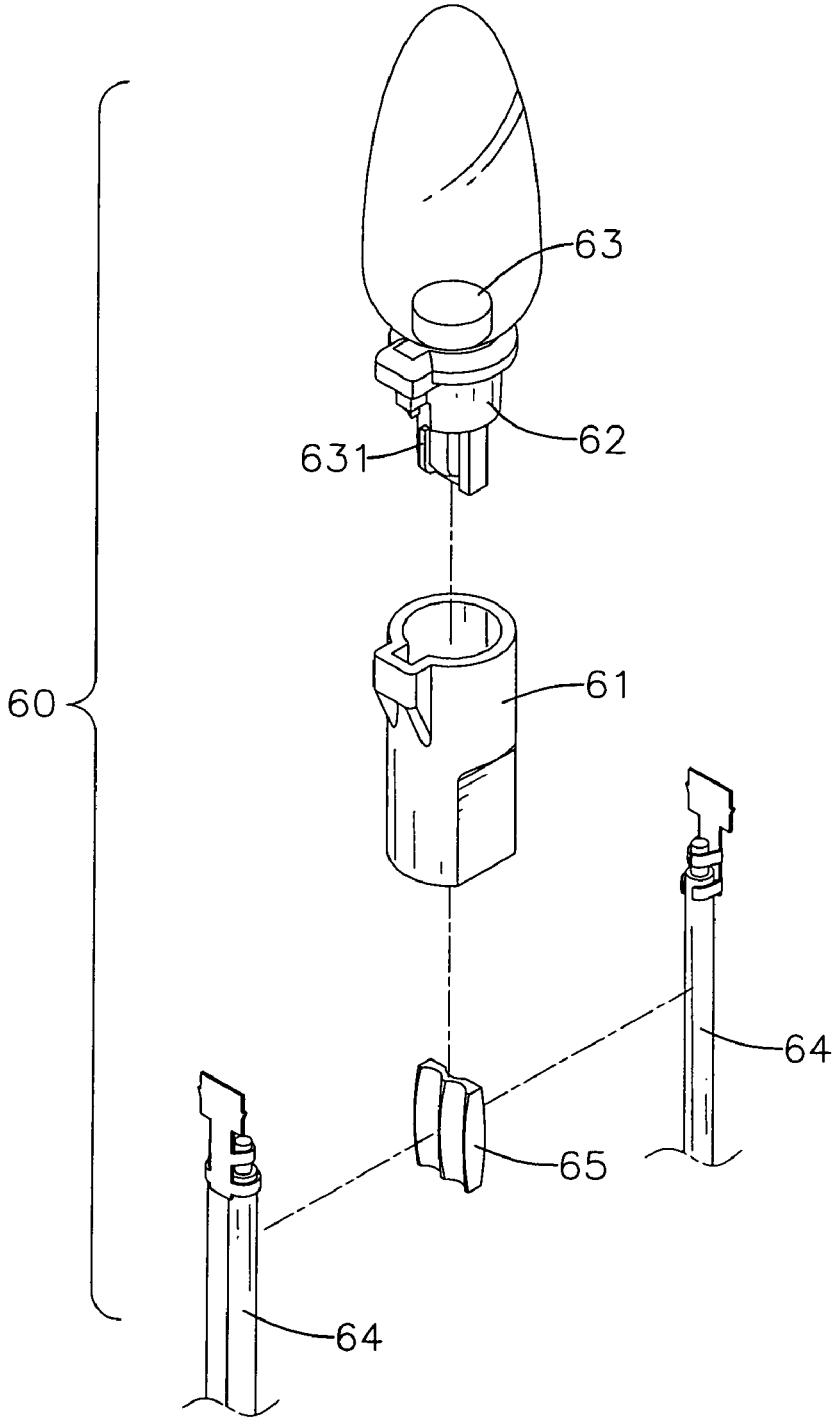
FIG.6 PRIOR ART
FIG. 6 is an exploded perspective view of a conventional fairy light in accordance with the prior art.

With further reference to FIGS. 2, 3 and 5, the LED (40) as described may be mounted in a fairy light in accordance with the present invention. The fairy light comprises a casing (10), the LED (40), a lens (20), two wires (30) and a partition (50).

Figure 4:
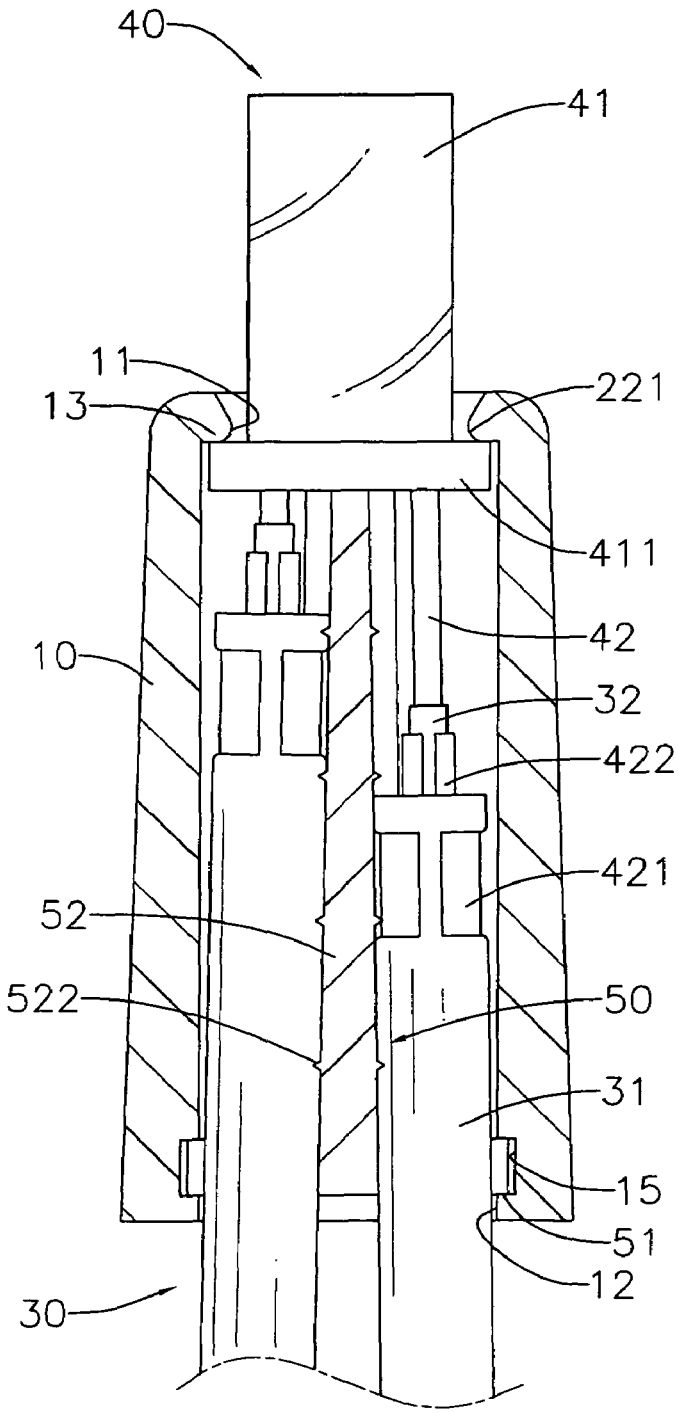
FIG. 4 is a side view in partial section of the fairy light in FIG. 2, shown a lens being omitted.

With further reference to FIG. 4, the casing (10) is tubular and has two ends, a light mount (11) and a wire mount (12) and may have an annular shoulder (13), an inner limiting protrusion (14) and an annular groove (15). The light mount (11) is formed in one end of the casing (10) and has an inner surface. The wire mount (12) is formed in the other end of the casing (10), communicates with the light mount (1) and has an inner surface. The annular shoulder (13) is formed around the inner surface of the light mount (11) adjacent to the corresponding end of the casing (10). The inner limiting protrusion (14) is formed around the inner surface of the light mount (11) near the annular shoulder (13). The annular groove (15) is formed around the inner surface of the wire mount (12) adjacent to the corresponding end of the casing (10).

The LED (40) is mounted in the casing (10) from the wire mount (12) to the light mount (11) of the casing (10). The body (41) of the LED (40) protrudes out from the light mount (11) of the casing (10). The annular flange (411) of the body (41) of the LED (40) may abut the annular shoulder (13) of the casing (10) or the inner limiting protrusion (14) of the casing (10).

The lens (20) is connected to the light mount (11) of the casing (10) and has an opening, a mounting tube (21) and an annular recess (22). The mounting tube (21) protrudes from and communicates with the opening of the lens (20), is mounted into the light mount (11) of the casing (10) and has an outer surface and a distal end. The distal end of the mounting tube (21) may abut the annular flange (411) of the body (41) of the LED (40). The annular recess (22) is formed around the outer surface of the mounting tube (21) and may engage the annular shoulder (13) of the casing (10) to hold the mounting tube (21) of the lens (20) securely in the casing (10).

The wires (30) are mounted in the wire mount (12) of the casing (10). Each wire (30) has an insulating shell (31) and an electric cord (32). The insulating shell (31) is held by the distal wire gripping protrusion (421) of the corresponding terminal (42) of the LED (40) and has a mounting end. The electric cord (31) is mounted in the insulating shell (31), protrudes out from the mounting end of the insulating shell (31) and is held by the proximal wire gripping protrusions (422) of the corresponding terminal (42) of the LED (40).

The partition (50) is mounted between the wires (30), is mounted securely in the wire mount (12) of the casing (10) to hold the wires (30) securely in the casing (10) and has a separator (52) and a cap (51).

The separator (52) is mounted between the wires (30), has two opposite mounting surface and an end and may have two wire recesses (521) and multiple ribs (522). The wire recesses (521) are respectively formed in the mounting surfaces of the separator (52) to allow the wires (30) to be respectively stored in the wire recesses (521). The ribs (522) are separately formed in the wire recesses (521) of the separator (52) of the partition (50) and may be perpendicular to the wires (30) to prevent the wires (30) to slide along the wire recesses (521).

The cap (51) is formed around the end of the separator (52), corresponds to and covers the wire mount (12) of the casing (10), may be mounted in the annular groove (15) of the casing (10) and has a sidewall and two mounting holes (511). The mounting holes (511) are formed oppositely in the sidewall of the cap (51), respectively correspond to the mounting surfaces of the separator (52) and are respectively mounted around the wires (30).

The LED (40) and the fairy light with the LED (40) as described have the following advantages. The distal and the proximal wire gripping protrusions (421, 422) of the terminals (42) of the LED (40) hold the insulating shells (31) and the electric cords (32) of the wires (30). Thus, the LED (40) is easily, securely and stably to be electrically connected to the wires (30) and such an assembling procedure can be done with automatic machines. Furthermore, the LED (40) is mounted into the casing (10) and is held in position only with the partition (50). Therefore, not only assembling processes but also assembling components of the LED (40) and the fairy light with the LED (40) as described are saved. Consequently, manufacturing costs are saved.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A fairy light comprising:

a casing being tubular and having
- two ends;
- a light mount being formed in one end of the casing and having an inner surface; and
- a wire mount being formed in the other end of the casing and communicating with the light mount and having an inner surface;
- a light emitting diode (LED) being mounted in the casing from the wire mount to the light mount of the casing and comprising
- a body protruding out from the light mount of the casing and having
  - an outer surface; and
  - a bottom;
- two terminals protruding from the bottom of the body, and each terminal having
  - at least one distal wire gripping protrusion being formed transversely on and protruding from the terminal; and
  - at least one proximal wire gripping protrusion being formed transversely on and protruding from the corresponding terminal;

two wires being mounted in the wire mount of the casing, and each wire having
- an insulating shell being held by the distal wire gripping protrusion of a corresponding terminal of the LED and having a mounting end; and
- an electric cord being mounted in the insulating shell, protruding out from the mounting end of the insulating shell and being held by the proximal wire gripping protrusion of the corresponding terminal of the LED; and a partition being mounted between the wires, is mounted securely in the wire mount of the casing and having
- a separator being mounted between the wires and having
  - two opposite mounting surface; and
  - an end; and
- a cap being formed on the end of the separator, corresponding to and covering the wire mount of the casing and having
  - a sidewall; and
  - two mounting holes being formed oppositely in the sidewall of the cap, respectively corresponding to the mounting surfaces of the separator and being respectively mounted around the wires.

2. The fairy light as claimed in claim 1, wherein the casing further has an annular shoulder being formed around the inner surface of the light mount adjacent to the corresponding end of the casing; and the body of the LED further has an annular flange being formed around the outer surface of the body near the bottom of the body and abutting the annular shoulder of the casing.

3. The fairy light as claimed in claim 1, wherein the casing further has
- an annular shoulder being formed around the inner surface of the light mount adjacent to the corresponding end of the casing; and
- an inner limiting protrusion being formed around the inner surface of the light mount near the annular shoulder; and the body of the LED further has an annular flange being formed around the outer surface of the body near the bottom of the body and abutting the inner limiting protrusion of the casing.

4. The fairy light as claimed in claim 1, wherein the casing further has an annular groove being formed around the inner surface of the wire mount adjacent to the corresponding end of the casing; and the cap of the partition is mounted in the annular groove of the casing.

5. The fairy light as claimed in claim 2, wherein the casing further has an annular groove being formed around the inner surface of the wire mount adjacent to the corresponding end of the casing; and the cap of the partition is mounted in the annular groove of the casing.

6. The fairy light as claimed in claim 3, wherein the casing further has an annular groove being formed around the inner surface of the wire mount adjacent to the corresponding end of the casing; and the cap of the partition is mounted in the annular groove of the casing.

7. The fairy light as claimed in claim 4, wherein the separator of the partition further has two wire recesses being respectively formed in the mounting surfaces of the separator.

8. The fairy light as claimed in claim 5, wherein the separator of the partition further has two wire recesses being respectively formed in the mounting surfaces of the separator.

9. The fairy light as claimed in claim 6, wherein the separator of the partition further has two wire recesses being respectively formed in the mounting surfaces of the separator.

10. The fairy light as claimed in claim 7, wherein the separator further has multiple ribs being separately formed in the wire recesses of the separator of the partition.

11. The fairy light as claimed in claim 8, wherein the separator further has multiple ribs being separately formed in the wire recesses of the separator of the partition.

12. The fairy light as claimed in claim 9, wherein the separator further has multiple ribs being separately formed in the wire recesses of the separator of the partition.

13. The fairy light as claimed in claim 10, wherein the ribs of the separator of the partition are perpendicular to the wires.

14. The fairy light as claimed in claim 11, wherein the ribs of the separator of the partition are perpendicular to the wires.

15. The fairy light as claimed in claim 12, wherein the ribs of the separator of the partition are perpendicular to the wires.

16. The fairy light as claimed in claim 1, wherein the casing further has an annular shoulder being formed around the inner surface of the light mount adjacent to the corresponding end of the casing;

the body of the LED further has an annular flange being formed around the outer surface of the body near the bottom of the body; and the fairy light further has a lens being connected to the light mount of the casing and having an opening;

a mounting tube protruding from and communicating with the opening of the lens, being mounted into the light mount of the casing and having an outer surface; and a distal end abutting the annular flange of the body of the LED; and an annular recess being formed around the outer surface of the mounting tube and engaging the annular shoulder of the casing.

* * * * *